United States Patent [19]

Beard

[11] 4,231,510

[45] Nov. 4, 1980

[54] LIGHT BULB CONTAINER

[75] Inventor: John M. Beard, Thamesford, Canada

[73] Assignee: A & C Boehmer Limited, Kitchener, Canada

[21] Appl. No.: 23,949

[22] Filed: Mar. 26, 1979

[30] Foreign Application Priority Data

Jul. 27, 1978 [CA] Canada ..... 308239

[51] Int. Cl.[3] ..... B65D 85/42

[52] U.S. Cl. ..... 229/39 B; 206/422

[58] Field of Search ..... 229/39 B; 206/418, 419, 206/420, 421, 422

[56] References Cited

U.S. PATENT DOCUMENTS

| | | | |
|---|---|---|---|
| 2,825,496 | 3/1958 | Meissler, Sr. | 229/39 D X |
| 2,940,653 | 6/1960 | Miessler, Sr. | 229/39 B |
| 3,069,008 | 12/1962 | Dugre | 229/39 B UX |
| 3,145,836 | 8/1964 | Tyrseck et al. | 229/39 B X |
| 3,820,707 | 6/1974 | Fischer | 229/39 B |
| 3,822,785 | 7/1974 | Getz et al. | 206/422 |
| 4,007,836 | 2/1977 | Getz et al. | 229/39 B X |
| 4,185,766 | 1/1980 | Davidson | 229/39 B |

*Primary Examiner*—Davis T. Moorhead

*Attorney, Agent, or Firm*—George H. Riches and Associates

[57] ABSTRACT

This invention relates to an improved open ended package or container which is formed from a one piece blank to hold a pair of light bulbs in an end to end relationship. The bulbs are spaced a desired distance from the open ends of the container and longitudinally retained in both directions as well as prevented from contacting each other in order to avoid breakage during shipping and storing. The one piece cardboard blank is folded and secured by adhesive strips at each end to form a rectangular sleeve having a top, bottom, two sides, two open ends, and a partition element. The partition element is provided with cut lines and fold lines to form two separating portions and two retaining portions, all of which extend across the container between the top and bottom, each in a different plane parallel to the two sides. When the bulbs are inserted into the container, the two separating portions are resiliently laterally deformed and prevent contact between the bulbs as well as longitudinally retain each of them in one direction. Each of the retaining portions extends across the container between the bulb portion of a bulb and a respective open end to longitudinally retain the bulb in the other direction. The invention provides a very economical light bulb container which protects the light bulbs while at the same time leaving them open for inspection.

4 Claims, 7 Drawing Figures

FIG.3.
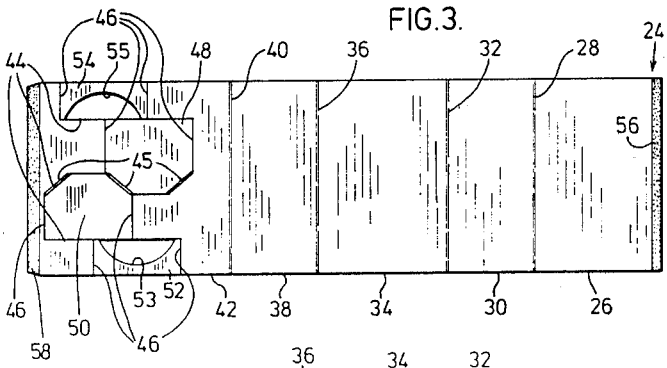
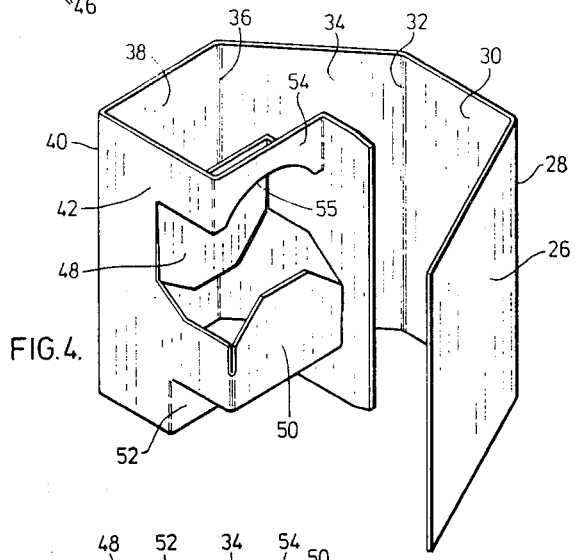
FIG.4.
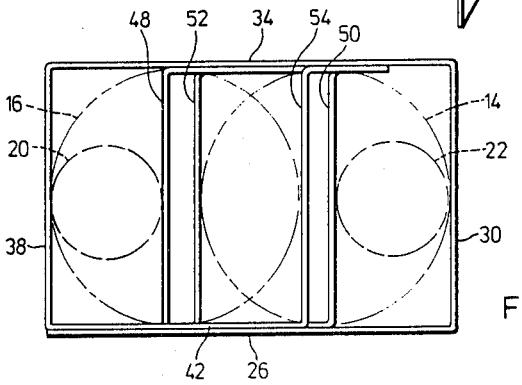
FIG.5.

LIGHT BULB CONTAINER

BACKGROUND OF THE INVENTION

This invention relates to containers and more particularly to an improved foldable package or container for holding a pair of light bulbs formed from a one piece cardboard blank which has a partition element with separating portions and retaining portions extending across the container.

In order to store, ship and retail light bulbs, it is necessary that they be contained in a package which securely retains them in the package while protecting them against breakage and at the same time exposes a portion of the bulb to view. In the past, it has been well known to package a pair of light bulbs in packages having an outer sleeve removable from an inner corrugated container. However, this had the disadvantage that at least a portion of the container was required to be corrugated to prevent the bulbs from falling out and the containers were relatively costly to manufacture on a large volume basis.

More recently, a variety of one piece containers formed from one piece paperboard or cardboard blanks have been proposed in order to reduce these costs. In such a container for a pair of bulbs, it is desirable to provide structure which adequately separates the bulbs from each other to prevent breakage of them and holds them securely in the package, while leaving the ends of the container open to inspect the bulbs. While these improved containers have required less material than the previous two piece ones, they still have disadvantages in the location and function of the various means provided to separate and/or retain the light bulbs in the container.

SUMMARY OF THE INVENTION

Accordingly, it is an object of the present invention to at least partially overcome these disadvantages by providing a further improved container for a pair of light bulbs formed from a one piece cardboard blank which has a partition element which provides an improved combination of bulb separating and retaining portions extending across the container.

To this end, in one of its aspects, the invention provides a folding open ended container for a pair of light bulbs, each having a bulb portion and a stem, said container formed from a one piece blank and comprising four interconnecting walls to define a rectangular sleeve having a top, bottom, two opposite sides, and two open ends, and a partition element having first and second separating portions and first and second bulb retaining portions, the separating and retaining portions each extending across the sleeve between the top and bottom, the bulbs being received in the container in end to end relationship with the separating portions of the partition element extending between the bulbs to prevent contact between them and each of the retaining portions of the partition element extending between the bulb portion of one of the bulbs and a respective open end of the container to longitudinally retain said bulb in the container.

Further objects and advantages of the invention will appear from the following description taken together with the accompanying drawings.

BRIEF DESCRIPTION OF THE DRAWINGS

FIG. 3 is a view of a one piece cardboard blank from which the container shown in FIG. 1 is formed;

FIG. 4 is a perspective view showing the one piece blank partially assembled;

FIG. 5 is an end view of the assembled container, indicating the location of the stem and bulb portions of the bulbs;

DETAILED DESCRIPTION OF THE DRAWINGS

Figure 1:
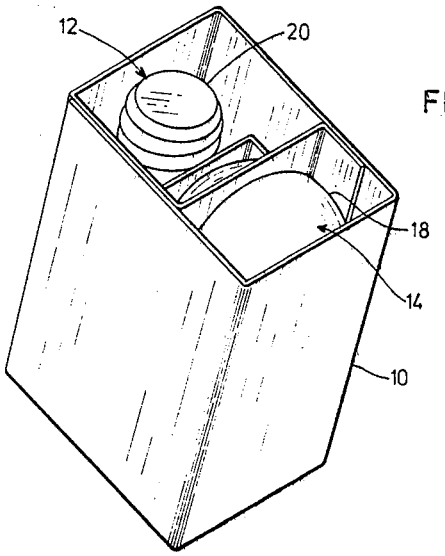
FIG. 1 is a perspective view of a light bulb container according to a preferred embodiment of the invention.
Figure 2:
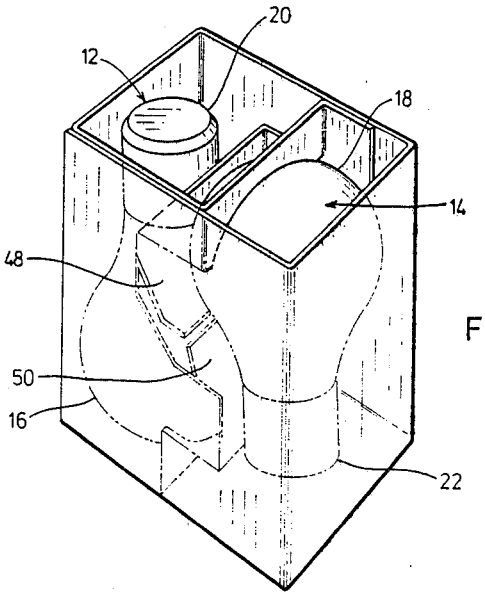
FIG. 2 is a view similar to FIG. 1 showing the location of the bulbs and the partition element.

Reference is first made to FIGS. 1 and 2 which show a container 10 holding a pair of light bulbs 12,14, each of which has a bulb portion 16,18 and a stem 20,22. As may be seen, the bulbs are positioned in the container in an end to end relationship.

Reference is now made to FIG. 3 which shows a one piece blank 24 from which the container 10 is formed. The blank 24 has a bottom panel 26 connected at first folding line 28 to a first side panel 30. First side panel 30 is connected at second fold line 32 to top panel 34. Top panel 34 is connected at third folding line 36 to second side panel 38 and second side panel 38 is connected at fourth folding line 40 to partition element 42. Partition element 42 has a number of cut lines 44 and eight folding lines 46 which define first and second separating portions 48,50, and first and second retaining portions 52,54. As may be seen, in this embodiment, the three diagonal cuts 45 are slightly spaced which avoids the separating portions 48,50 catching on each other.

The blank 24 has adhesive strips 56,58 at each end which are used to form the container. The blank 24 is folded at each of the fold lines as shown in FIG. 4, and adhesive strip 58 is secured to the inside of the top panel 34 while adhesive strip 56 is secured to the outside of the partition element 42 to form the container 10. As may clearly be seen in FIG. 5, this forms a rectangular sleeve with the first and second separating portions 48,50 and the first and second retaining portions 52,54 of the partition element 42 extending across parallel to the side panels 30,38 in four separate pasallel planes.

Figure 6:
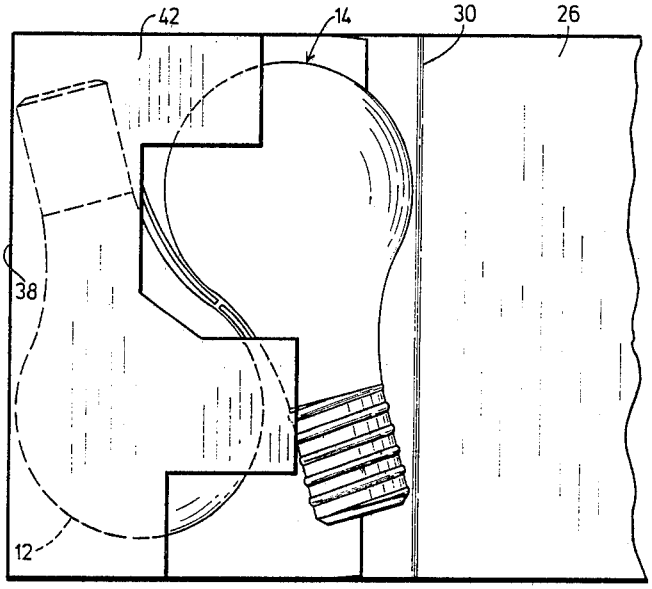
FIG. 6 is a view showing the bulbs located in a partially assembled container.
Figure 7:
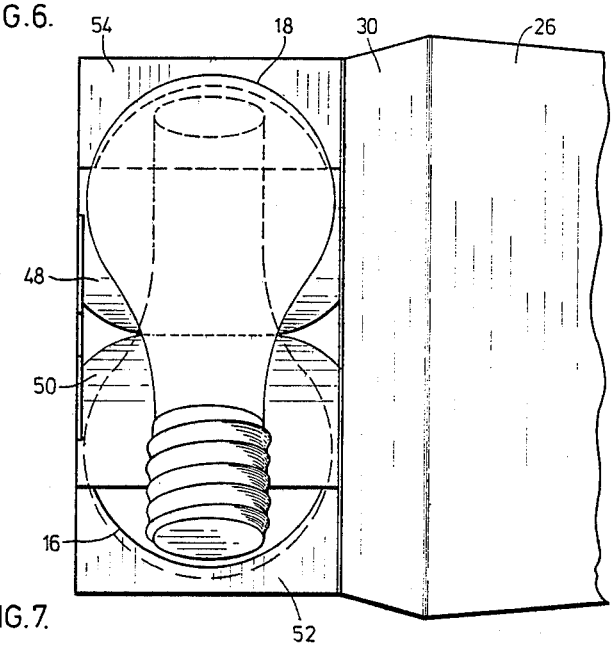
FIG. 7 is a view similar to FIG. 6 from the side.

In use, the blank 24 is folded as described above to form the container and the light bulbs 12,14 are then inserted. As may best be seen in FIGS. 2 and 4, each of the fold lines between the first and second separating portions 48,50 and the remainder of the partition element 42 is partially cut to enable the first and second separating portions 48,50 to be resiliently laterally displaced by the bulbs. Thus, as clearly seen in FIG. 6, the first and second separating portions 48,50 prevent contact between the light bulbs 12,14 and as well prevent them from being longitudinally displaced out of the container stem first by holding the stems of the bulbs against the adjacent sides of the container. The first and second retaining portions 52,54 each extend across the container adjacent to a respective one of the open ends 60,62, and each has a curved inner edge. The bulb portion of each one of the bulbs abuts on the curved edge 53,55 of a respective one of the retaining portions 52,54 to space the bulb from the open end of the container and prevents the bulb from being displaced from the container, bulb end first. As may be seen, the curved edges 53,55 of the retaining portions 52,54 are formed by cutting out segments of the partition element 42. The shape and dimensions of these segments are determined to facilitate bending of the retaining portions 52,54 without losing their holding strength. Furthermore, it will be apparent that the size of the retaining portions 52,54 determines the spacing of the bulbs from the open ends of the container.

Thus it may be seen that the bulb container according to the invention embodying the concept of a partition element having four different portions extending across the container provides a very simple construction using a minimum of cardboard in a one piece blank to retain the bulbs against longitudinal movement in either direction and to prevent contact between them, while at the same time leaving the ends of the bulbs very open for inspection by a prospective purchaser. Although the description of this invention has been given with respect to a particular embodiment, it is not to be construed in a limiting sense. Many variations and modifications in shape and location of the separating and retaining portions of the partition element 42 will now occur to those skilled in the art. Furthermore, it will be apparent that fastening means other than the adhesive strips 56,58 may be used to form the container 10 from the one piece blank 24. For a definition of the invention, reference is made to the appended claims.

What I claim is:

1. A folding open ended container for a pair of light bulbs, each having a bulb portion and a stem, said container formed from a one piece blank and comprising:

(a) four interconnecting walls to define a rectangular sleeve having a top, bottom, two opposite sides, and two open ends, and (b) a partition element having first and second separating portions and first and second bulb retaining portions, the separating and retaining portions each extending across the sleeve between the top and bottom, the bulbs being received in the container in end to end relationship with the separating portions of the partition element extending between the bulbs to prevent contact between them and each of the retaining portions of the partition element extending between the bulb portion of one of the bulbs and a respective open end of the container to longitudinally retain said bulb in the container.

2. A folding container as claimed in claim 1 wherein the separating and retaining portions of the partition element extend parallel to the sides of the sleeve.

3. A folding container as claimed in claim 2 wherein the separating and retaining portions of the partition element are all located in different planes.

4. A folding container as claimed in claim 1, wherein each of the separating portions of the partition element holds the stem of a respective one of the light bulbs against the adjacent side of the sleeve.

* * * * *